US011358857B2

(12) United States Patent
Brosio et al.

(10) Patent No.: US 11,358,857 B2
(45) Date of Patent: Jun. 14, 2022

(54) APPARATUS FOR MANUFACTURING PILLOWS

(71) Applicant: G TECHNOLOGIES S.R.L., Cermenate Co (IT)

(72) Inventors: Matteo Brosio, Novedrate (IT); Pasquale Brosio, Novedrate (IT)

(73) Assignee: G TECHNOLOGIES S.R.L., Cermenate Co (IT)

( * ) Notice: Subject to any disclaimer, the term of this patent is extended or adjusted under 35 U.S.C. 154(b) by 687 days.

(21) Appl. No.: 16/340,715

(22) PCT Filed: Oct. 11, 2017

(86) PCT No.: PCT/EP2017/075960
§ 371 (c)(1),
(2) Date: Apr. 10, 2019

(87) PCT Pub. No.: WO2018/069403
PCT Pub. Date: Apr. 19, 2018

(65) Prior Publication Data

US 2021/0395072 A1 Dec. 23, 2021

(30) Foreign Application Priority Data

Oct. 12, 2016 (IT) ..... 102016000102562

(51) Int. Cl.
*B68G 7/05* (2006.01)
*B68G 7/06* (2006.01)
*B68G 15/00* (2006.01)

(52) U.S. Cl.
CPC ..... *B68G 7/05* (2013.01); *B68G 7/06* (2013.01); *B68G 15/005* (2013.01)

(58) Field of Classification Search
CPC ..... B68G 7/05; B68G 7/06; B68G 15/005
See application file for complete search history.

(56) References Cited

U.S. PATENT DOCUMENTS 5,457,864 A * 10/1995 Sakaida ..... B68G 7/05 29/91.5
5,586,377 A * 12/1996 Katsuta ..... B68G 7/05 29/91.5

(Continued)

FOREIGN PATENT DOCUMENTS

DE 1233772 B 2/1967
EP 0 401 137 A1 12/1990

(Continued)

OTHER PUBLICATIONS

International Search Report, dated Dec. 19, 2017 (3 pages).

*Primary Examiner* — Ryan J. Walters
(74) *Attorney, Agent, or Firm* — Jacobson Holman PLLC

(57) ABSTRACT

Apparatus for manufacturing pillows, comprising:
at least one first bobbin of a first fabric and a second bobbin of a second fabric,
means adapted to place the first fabric on the second fabric along their advancement path,
means configured to drag the fabrics,
a pair of side welding devices for welding the side edges of first and second fabrics,
a transverse welding device adapted to weld the fabrics found in a tubular envelope transversally to the advancement path for forming a pillowcase,
a press for pressing the first fabric onto the second fabric when the length of the pillow reaches the desired length,
means adapted to insert material inside the pillowcase,
means for cutting the fabrics welded by the transverse welding device to separate the pillow from the successive pillow.

18 Claims, 17 Drawing Sheets

(56) References Cited

U.S. PATENT DOCUMENTS

| | | | | |
|---|---|---|---|---|
| 5,669,130 | A * | 9/1997 | Katsuta | B60N 2/5891 29/91.5 |
| 6,506,429 | B1 | 1/2003 | Recchia, Jr. | |
| 2016/0214785 | A1 | 7/2016 | Jan | |

FOREIGN PATENT DOCUMENTS

| | | | |
|---|---|---|---|
| WO | 88/05421 | A1 | 7/1988 |
| WO | 00/75016 | A1 | 12/2000 |

* cited by examiner

A

B

APPARATUS FOR MANUFACTURING PILLOWS

BACKGROUND OF THE INVENTION

The present invention relates to an apparatus for manufacturing pillows.

The use is known of pillows for sofas or other, manufactured with a fabric polyester cover and filled with different fibers, goose down or other.

The pillows are manufactured manually by sewing the edges of the two parts of fabric representing the cover of the pillow. The sewing is performed manually and this requires the action of various people; moreover, this limits the production of pillows by a company.

In view of the state of the art, it is the object of the present invention to provide an apparatus for manufacturing pillows.

BRIEF SUMMARY OF THE INVENTION

According to the present invention, such an object is achieved by means of an apparatus for manufacturing pillows comprising:

- at least one first bobbin of a first fabric and a second bobbin of a second fabric,
- means adapted to place the first fabric on the second fabric along their advancement path,
- means configured to drag the first and the second fabrics,
- a pair of side welding devices for welding the side edges of the first and the second fabrics, thus forming a tubular envelope with the first and the second fabrics,
- a transverse welding device adapted to weld the first and the second fabrics of the tubular envelope transversally to the advancement direction of the fabrics, to form the pillowcase,
- a press for pressing the first fabric, transversally to the advancement direction of the fabrics, onto the second fabric when the length of the pillow reaches the desired length,
- means adapted to insert material inside the pillowcase,
- means for cutting the fabrics welded by the transverse welding device to separate the manufactured pillow from the initial part of the successive pillow.

DESCRIPTION OF THE DRAWINGS

The features and advantages of the present invention will become apparent from the following detailed description of a practical embodiment thereof, shown by way of non-limiting example in the accompanying drawings, in which.

DETAILED DESCRIPTION OF THE INVENTION

Figure 1:
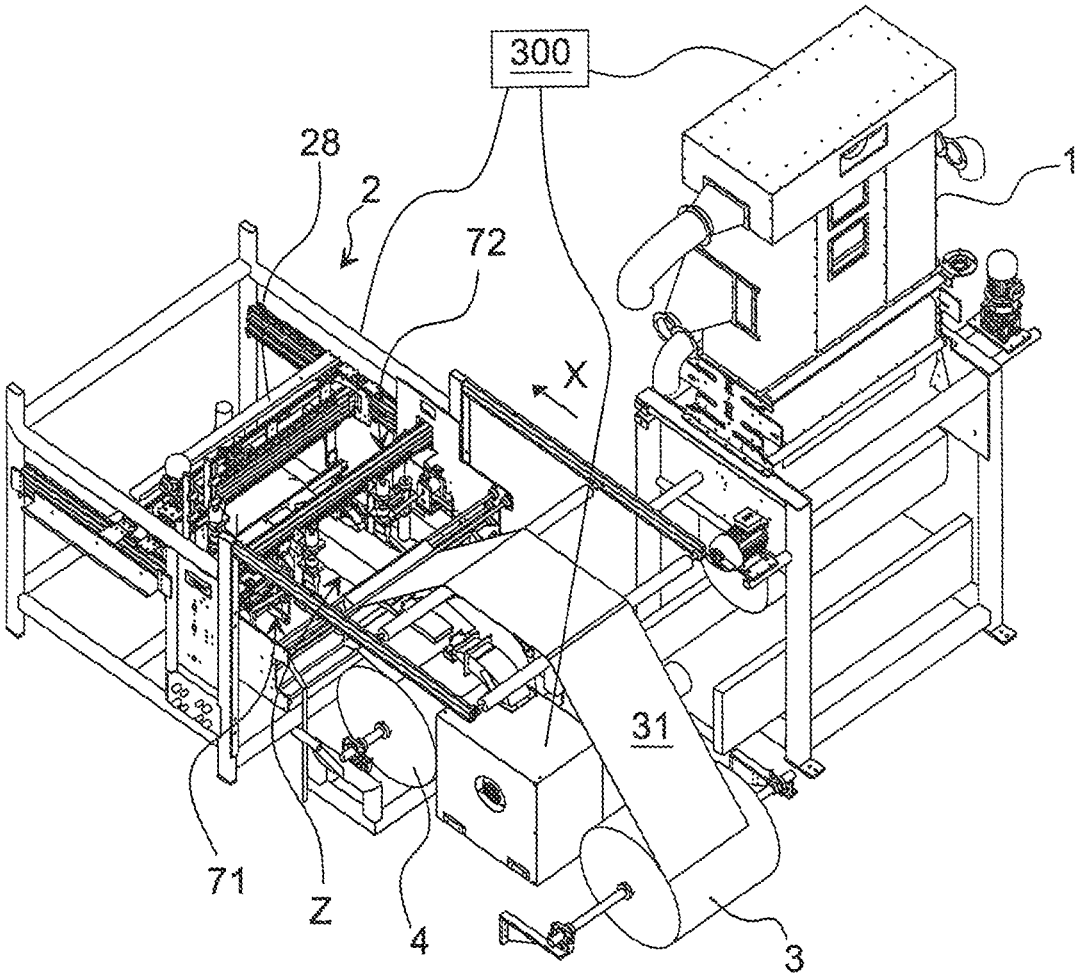
FIG. 1 is a perspective view of the apparatus for manufacturing pillows according to the present invention.
Figure 2:
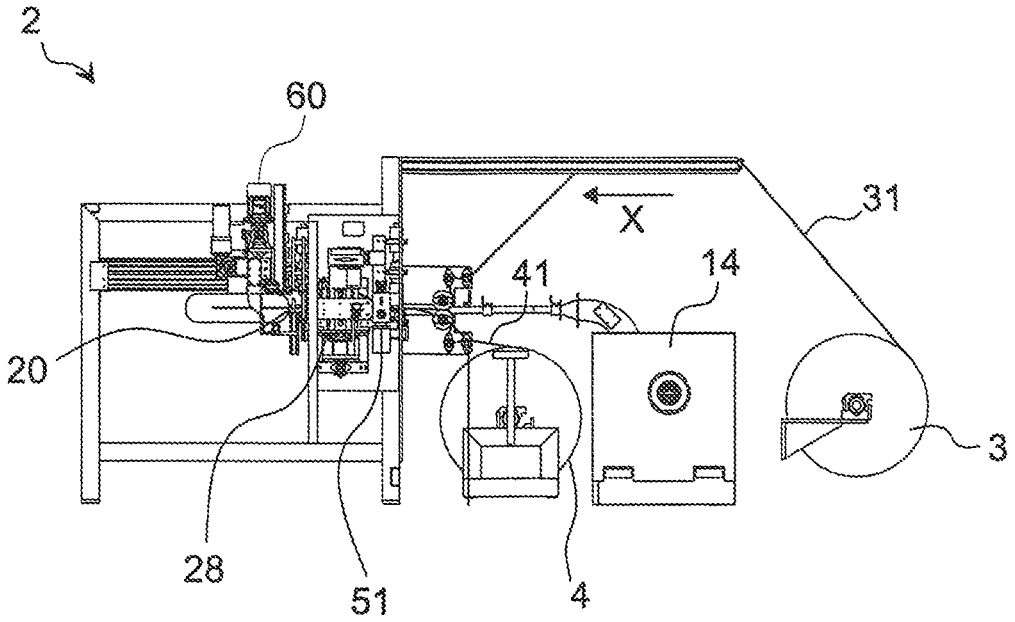
FIG. 2 is a side view of a part of the apparatus in FIG. 1.
Figure 3:
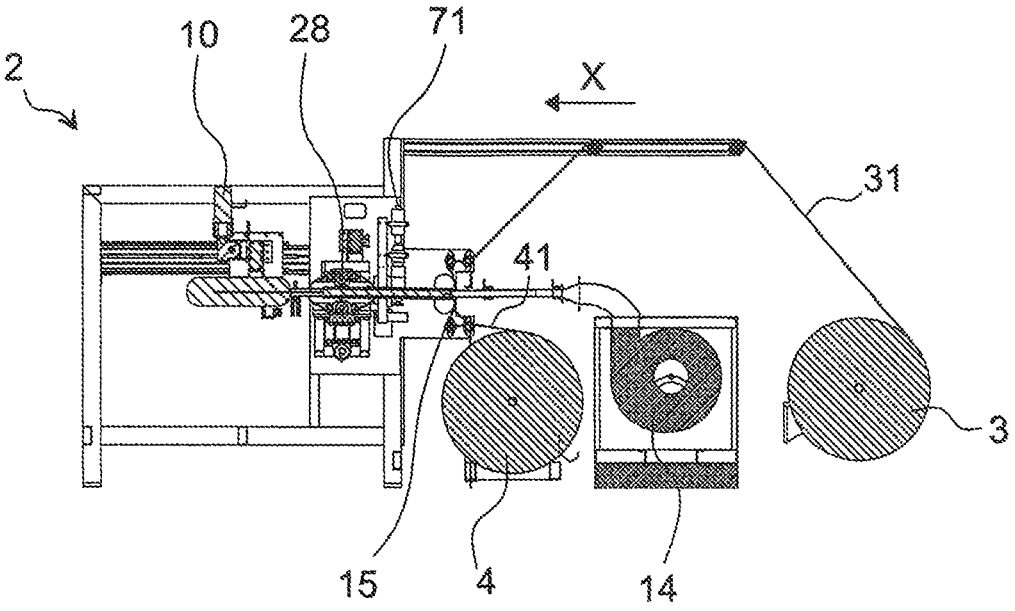
FIG. 3 is a longitudinal sectional view of the part of the apparatus in FIG. 2.
Figure 4:
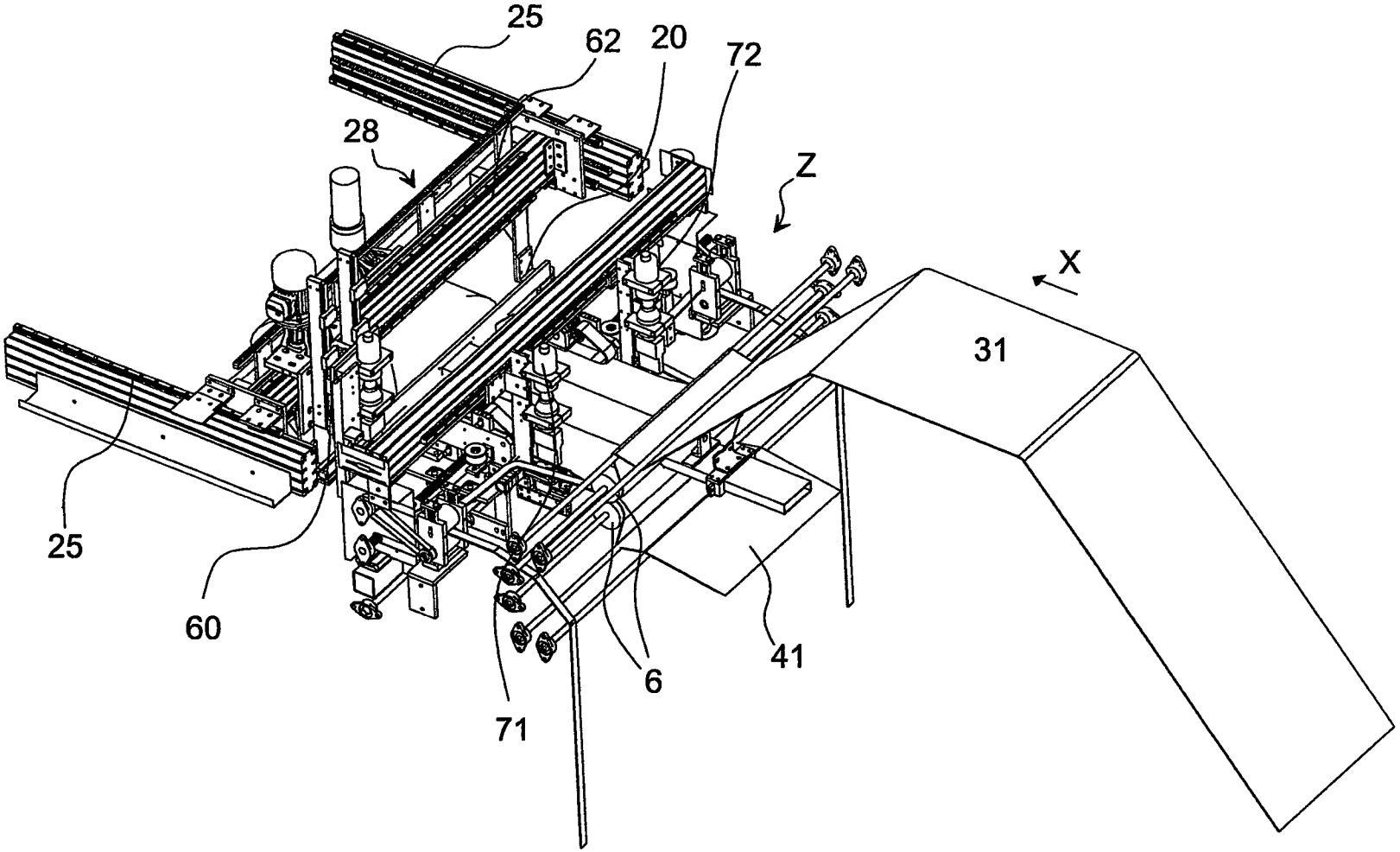
FIG. 4 is a detailed view of another part of the apparatus in FIG. 1.

FIGS. 1 to 25 describe an apparatus for manufacturing pillows according to the present invention. The apparatus comprises a machine 1 adapted to insert fibers inside a pillow 10 and a machine 2 adapted to make the pillow 10.

Machine 2 comprises a first bobbin 3 of fabric 31, preferably of polyester, for example TNT or polypropylene or microfiber, arranged in the lower part of the machine, and a second bobbin 4 of fabric 41, preferably of polyester, for example TNT or polypropylene or microfiber, again arranged in the lower part of the machine (FIGS. 1 to 3, 9). Fabric 31 from bobbin 3 passes over idler rollers 5 which allow fabric 31 to have the required tension for the formation of the pillow.

Fabric 31 from bobbin 3 engages with fabric 41 from bobbin 4 by means of other rollers 6 to form the pillow. The other rollers 6 arrange the fabric 31 over the fabric 41 to form the pillow.

Figure 8:
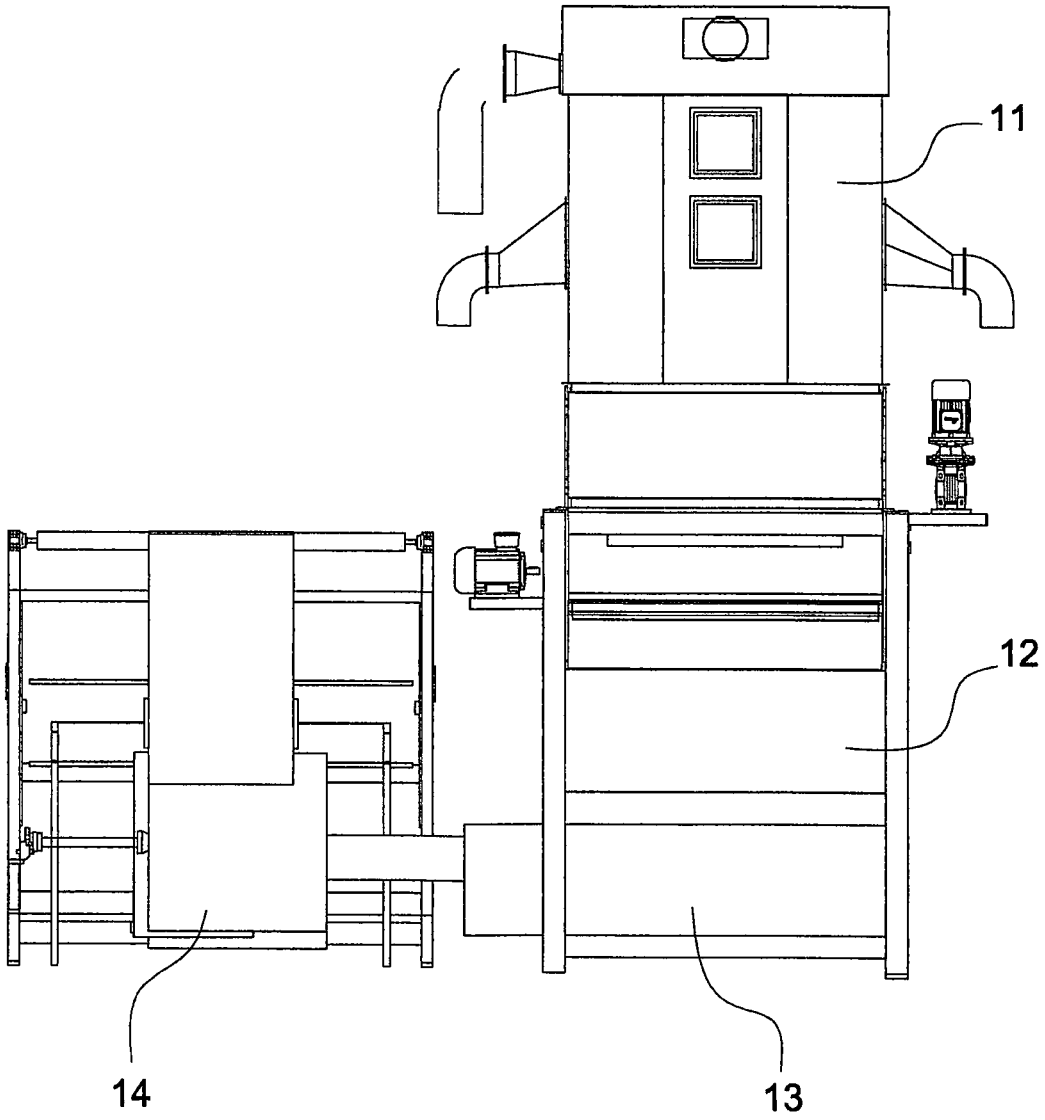
FIG. 8 is a front view of the apparatus in FIG. 1.
Figure 9:
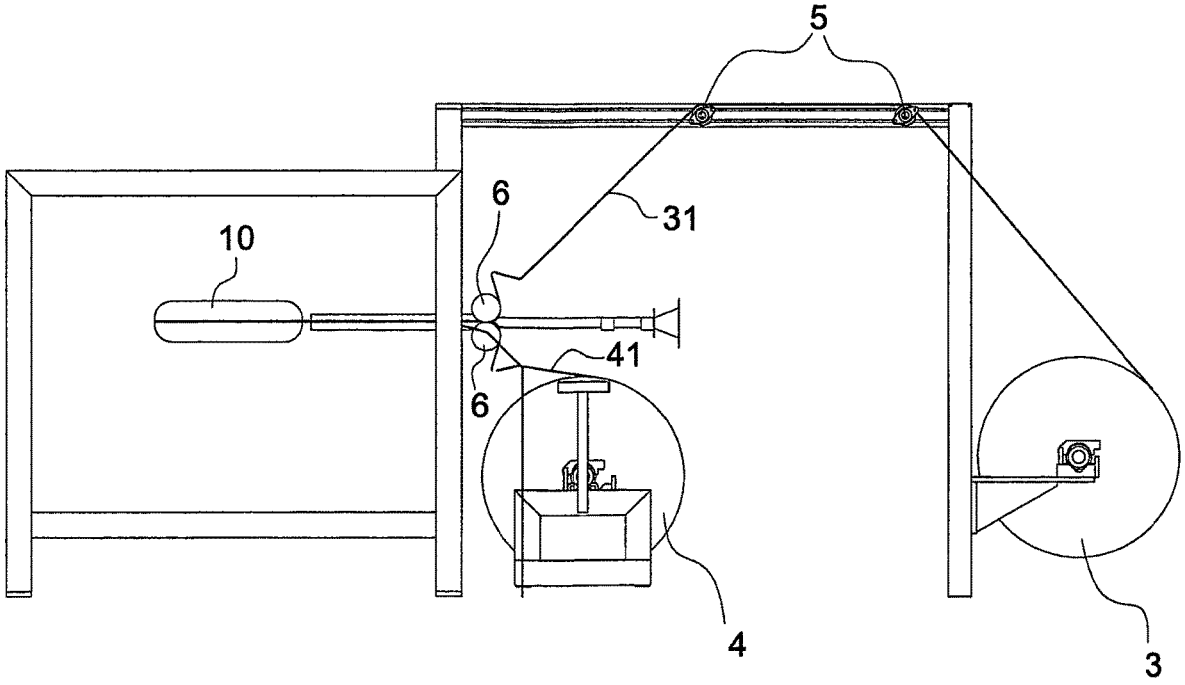
FIG. 9 is a diagrammatic side view of the apparatus in FIG. 1.

As shown in FIGS. 1 and 8, machine 1 comprises a container or silo 11 adapted to contain the fiber to be transported inside pillow 10, a scale 12 for weighing the quantity of fiber to be inserted into the pillow, a conveyer belt 13 for transporting the quantity of weighed fiber inside a fan 14 which in turn is adapted to insert the fiber inside pillow 10.

Figure 6:
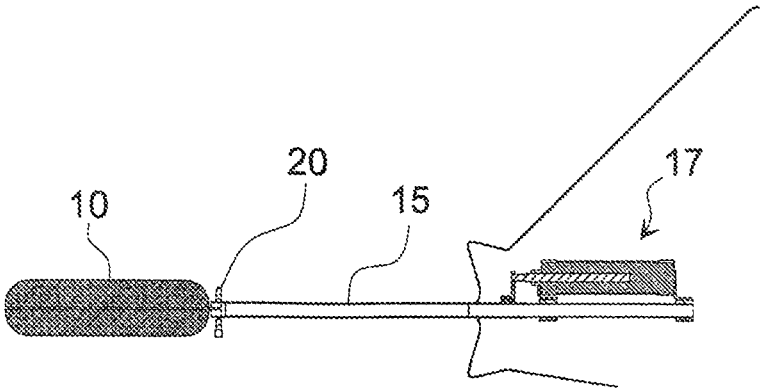
FIGS. 6 and 7 are sectional views of the filling elements of the pillow in rest position (FIG. 6) and working position (FIG. 7)
Figure 7:
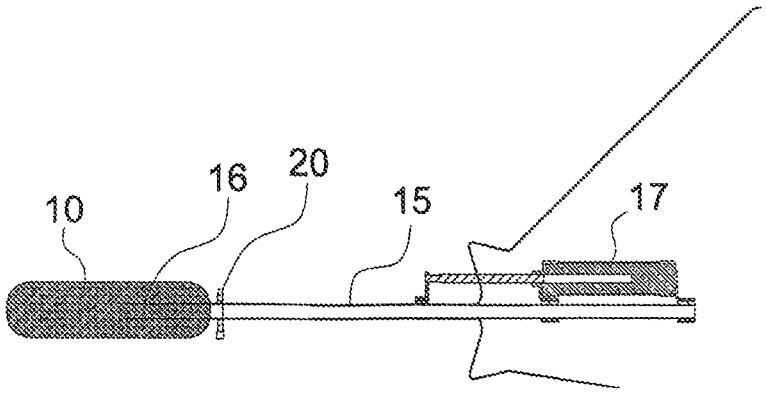

Fan 14 (shown best in FIGS. 2 and 3) is adapted to channel the quantity of weighed fiber inside a telescopic pipe 15 comprising an end part 16 (best shown in FIGS. 6 and 7). There is a device 17 adapted to move the telescopic pipe 15.

Figure 19:
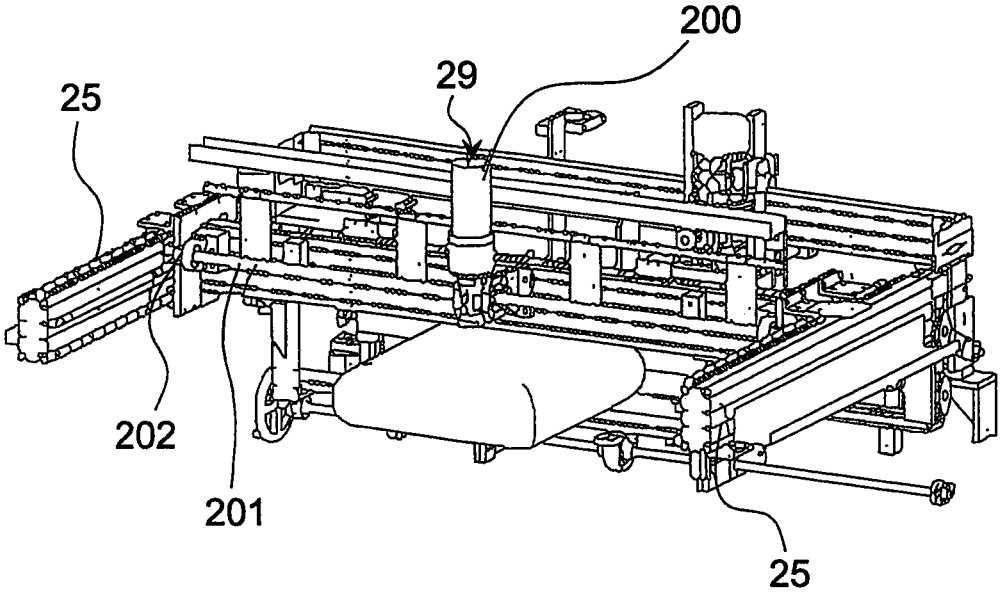
FIG. 19 diagrammatically shows a device for the longitudinal movement of the press.

Machine 2 comprises a press 20 adapted to press the fabrics 31 and 41 onto each other (FIGS. 4, 10, 12 to 16); in particular, press 20 is carried by a frame 28 which moves longitudinally by means of movement means 29, for example comprising an electric motor 200 adapted to rotate a shaft 201 which is integral at the ends with two pinions 202 which are movable on rack guides 25, as shown in FIG. 19. Press 20 is movable in the advancement path of the fabrics 31, 41 between two positions A, FIGS. 10A, and B, FIG. 10B along two longitudinal guides 25. Press 20 comprises two clamps 22, 23 shaped so that when they are pressed on each other, they cause a space 21 for the insertion of the end part 16 of the pipe 15.

Figure 10A:
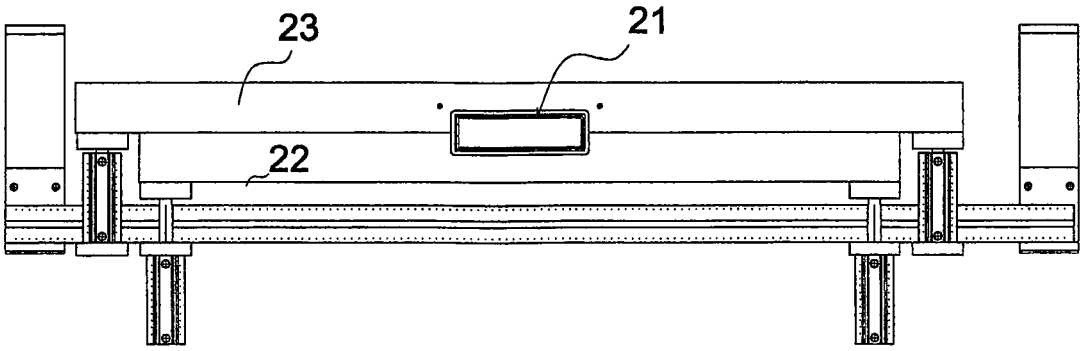
FIGS. 10A, 10B, and 10C show the three positions of the press of the apparatus in FIG. 1.

In a first position A, FIG. 10A, press 20 compresses the fabrics 31 and 41 on each other and allows the end part 16 of the telescopic pipe 15 to cross space 21 inside of the two parts of fabric 31, 41 to fill pillow 10 with the fiber weighed beforehand.

Figure 10B:
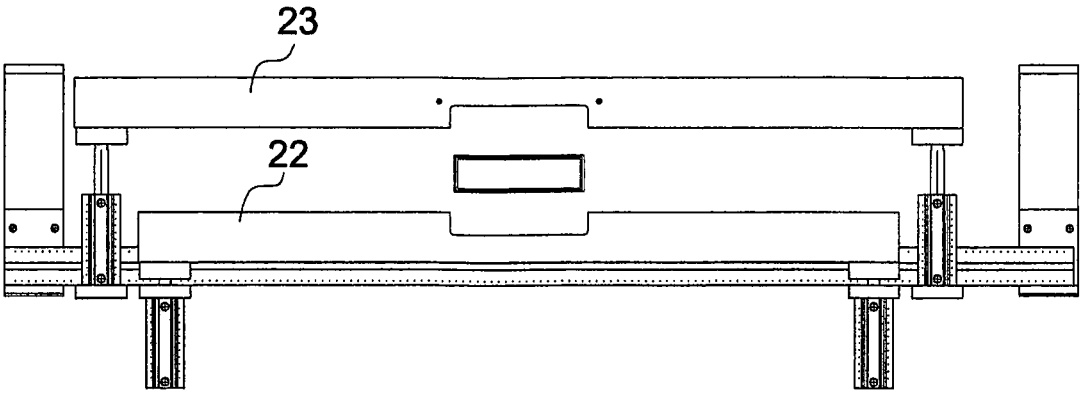
Figure 10C:
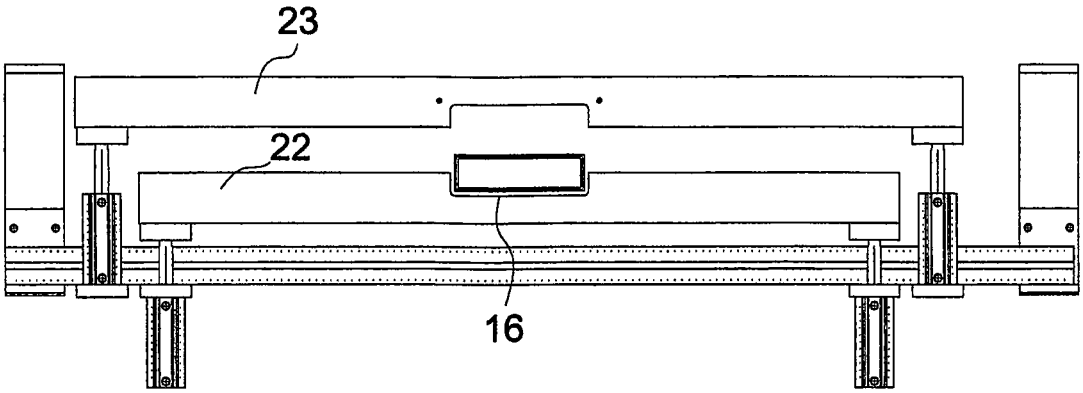

Once the pillow has been filled with the fiber, press 20 is moved along the advancement direction X of the fabrics 31, 41 and always keeping fabric 41 pressed onto fabric 31, up to reaching a second position B, FIG. 10B at a given distance D from position A, FIG. 10A; press 20 is at a longer distance from the first bobbin 3 and from the second bobbin 4 in position B than in position A. Press 20 is opened in position B, FIG. 10B, and the clamps 22, 23 slide on the respective fabrics 41, 31 when press 20 is brought back to position A, FIG. 10A, where again the clamps 22, 23 keep fabric 41 pressed on fabric 31 to allow the filling with fiber of a new pillow.

Figure 5:
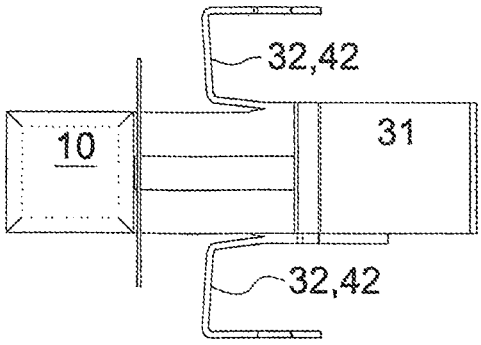
FIG. 5 is a diagrammatic top view of the apparatus in FIG. 1.

Machine 2 comprises two side welding units 71, 72 (best shown in FIG. 17) arranged on a frame 78, which are adapted to laterally weld the edges of the fabrics 31, 41 to form the side edges of pillow 10, and which are provided with cutting means for cutting the remaining side parts 32, 42 of the fabrics 31, 41 or selvedges 32, 42, as best shown in FIG. 5. The side welding units 71, 72 are arranged in machine 2 in front of press 20 in the advancement path of the fabrics 31, 41 along direction X.

Figure 11A:
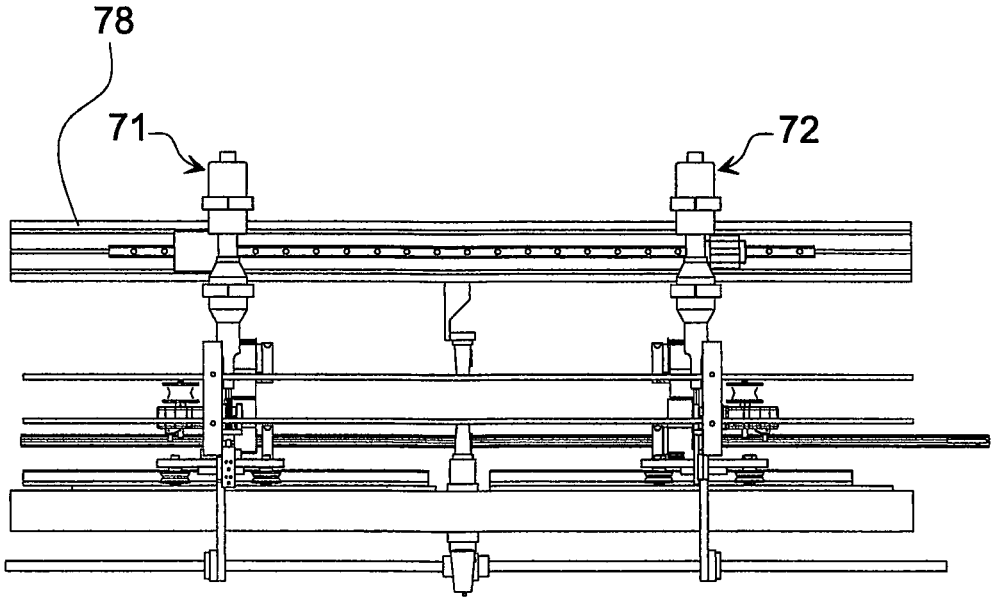
FIGS. 11A and 11B show the adjustable side ultrasound devices.
Figure 11B:
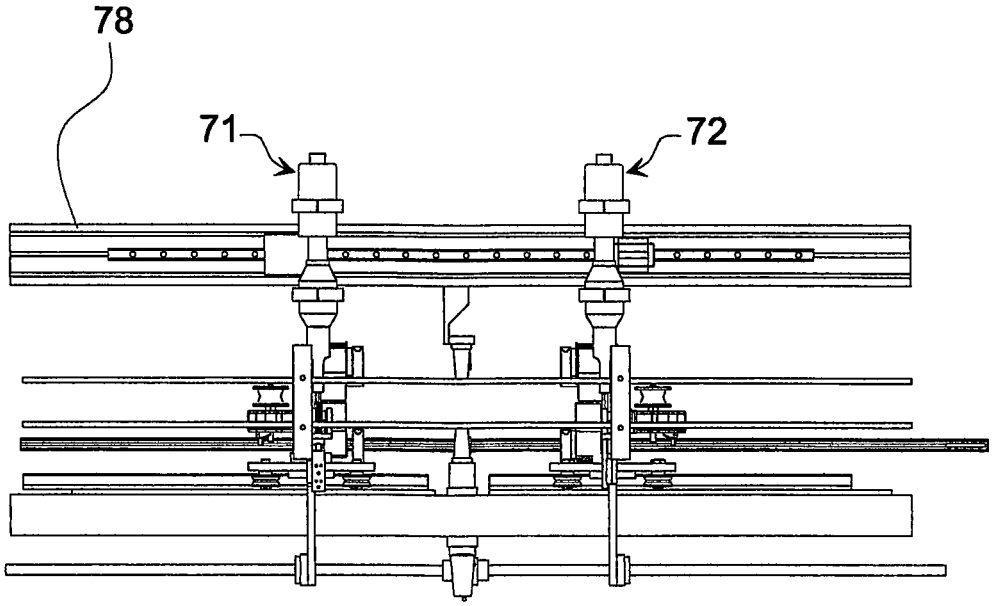
Figure 12:
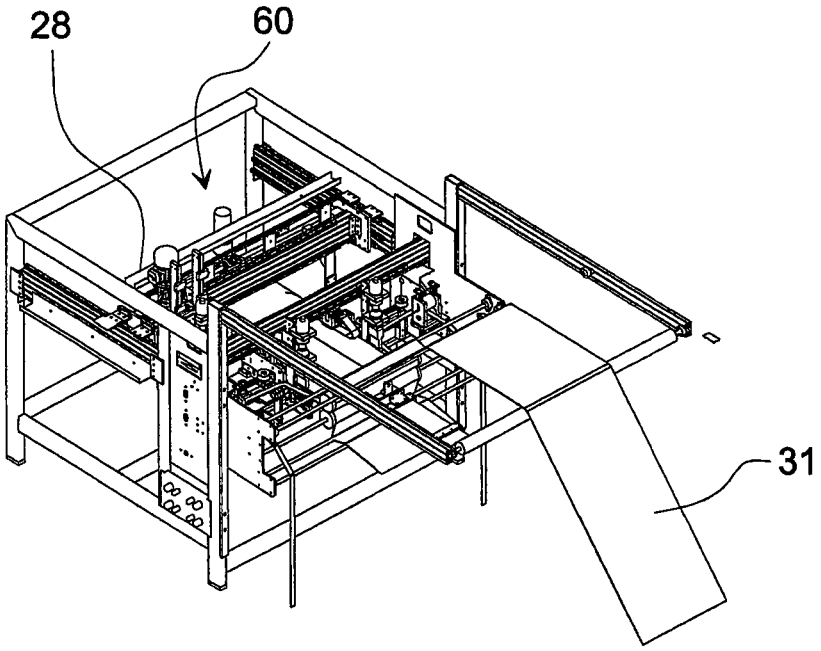
FIGS. 12 and 13 diagrammatically show the steps of filling (FIG. 12) and welding and cutting (FIG. 13) the pillow.
Figure 13:
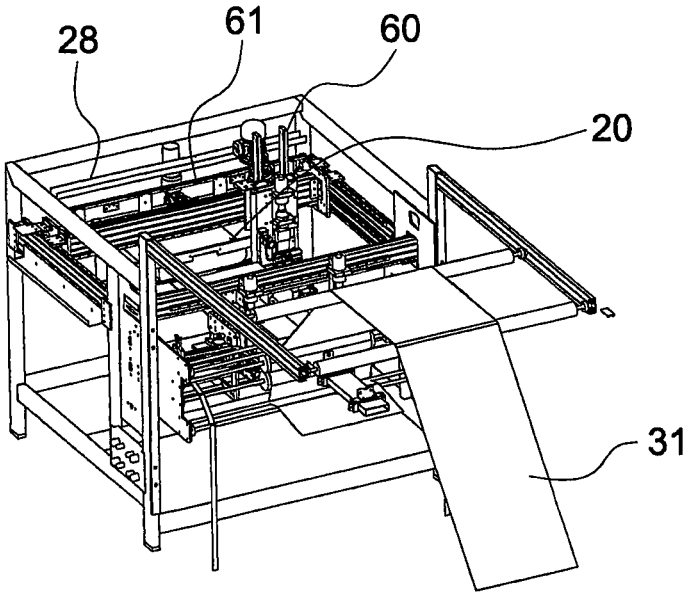

The side welding units 71, 72 are movable transversally to the advancement direction of the fabrics 31, 41 so that a user may move them transversally to adapt them to the desired width of pillow 10, as shown in FIGS. 11A and 11B.

Each of the side welding units 71, 72 comprises an ultrasound device 73 which, by means of a counter roller 74, preferably a toothed roller, arranged below device 73 and moved by a motor 76, is adapted to weld the fabrics 31, 41. Each of the side welding units 71, 72 also comprises a normally fixed roller 75 adapted to cut the fabrics 31, 41 after the welding thereof.

Figure 20:
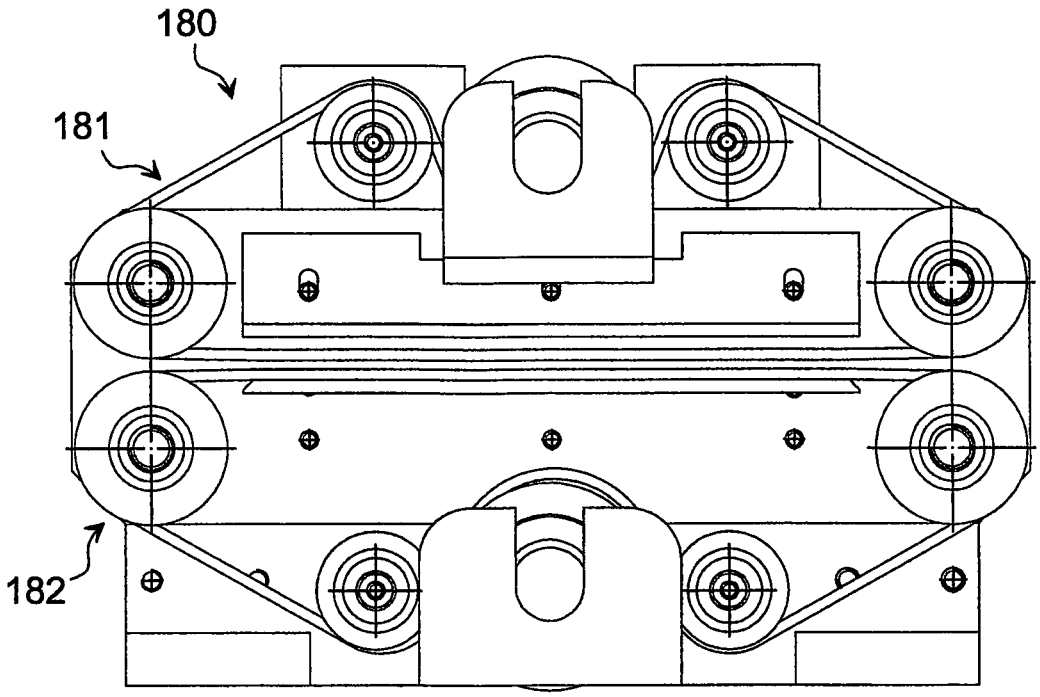
FIG. 20 diagrammatically shows a track unit for dragging fabrics.

Machine 2 comprises two track units 180 for dragging the fabrics 31, 41, one of which is shown in FIG. 20; the track units 180 are arranged after the side welding units 71, 72 in the advancement path of the fabrics 31, 41. The track units 180 determine length L of the pillowcase 10. Each track unit 180 comprises an upper subunit 181 and a lower subunit 182; the subunits 181 and 182 are of the belt type and the tracks are moved by suitable movement means (for example electric motors) (not shown in the drawings). The fabrics 31, 41 are arranged between the subunits 181, 182 for the dragging thereof a longitudinal direction. The track units 180 are controlled by a control device 300 (shown indicatively in FIG. 1), which causes length L of pillow 10.

There are also two units 51 adapted to collect the remaining side parts 32, 42 of the fabrics 31, 41 or selvedges 32, 42 and to bring them to a zone external to the working area Z of the machine. The units 51 each comprise two tensioner rolls 52, one of which is moved by an electric motor by means of a driving belt 53 which engages with a grooved shaft 54 moved by the electric motor.

Machine 2 also comprises a transverse welding unit 60 adapted to weld and cut the fabrics 31, 41 to form the pillow 10 (FIGS. 4, 14 to 16). The transverse welding unit 60 is movable transversally to the advancement direction X of the fabrics 31, 41 along a transverse guide 61 to weld the fabrics 31, 41, and is provided with cutting means for cutting the fabrics 31, 41 transversally to the advancement direction thereof. The transverse welding unit 60 is carried by the frame 28 of press 20 and therefore is also movable in the advancement direction of the fabrics 31, 41 between the two directions A and B, like press 20. The transverse welding unit 60 is adapted to weld and immediately thereafter cut the fabrics 31, 41 during the movement of press 20 from the first position A, FIG. 10A, to the second position B, FIG. 10B.

The transverse welding unit 60 comprises an ultrasound device 61 which, by means of a counter roller 63, preferably a toothed roller, arranged below device 62 and moved by a motor 66, is adapted to weld the fabrics 31, 41. The transverse welding unit 60 also comprises a normally fixed roller 65 adapted to cut the fabrics 31, 41 immediately after the welding thereof. Roller 65 is arranged close to the ultrasound device in the advancement path of the fabrics 31, 41. There is a saddle 67, with which the ultrasound device 61 and the rollers 63 and 65 are integral; saddle 67 is vertically movable by means of vertical movement means 68 to pass from a rest position μl, FIG. 14, to a working position B1, FIGS. 15 and 16, and vice versa, and is movable transversally to the advancement direction of the fabrics 31, 41 on guide 62 by means of an electric motor 69. In the rest position μl, FIG. 14, the saddle does not hinder the working area for manufacturing the pillow since it does not interfere with press 20, with the fabrics 31, 41 or with the telescopic pipe 15.

Preferably, the apparatus according to the invention also comprises a labeler 350 of the pillow 10.

Figure 21:
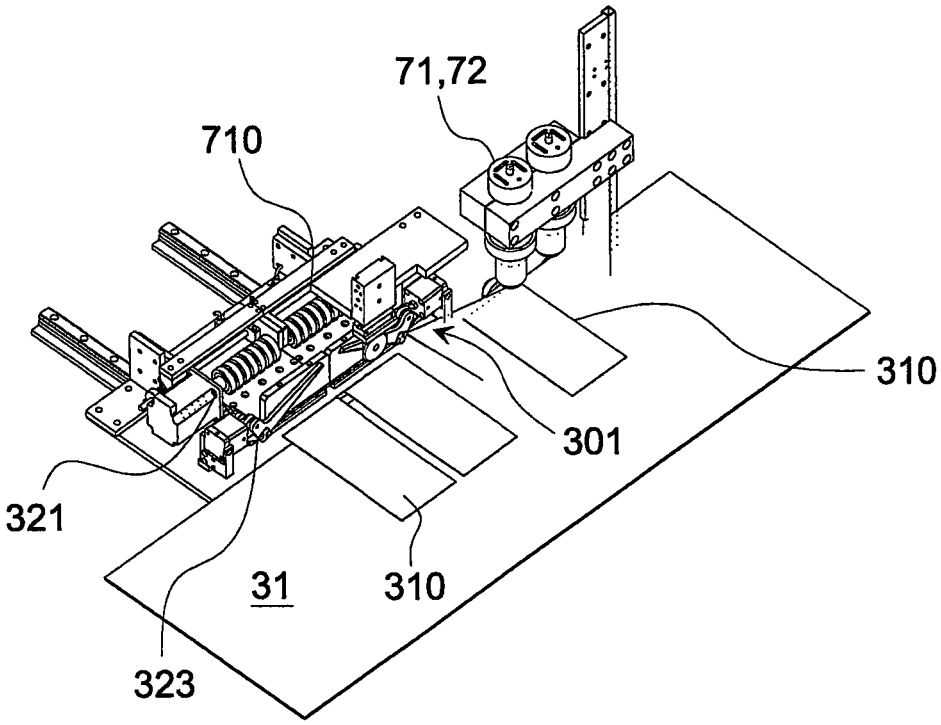
FIG. 21 is a perspective view of a labeler used in the apparatus for manufacturing pillows according to the present invention.
Figure 22:
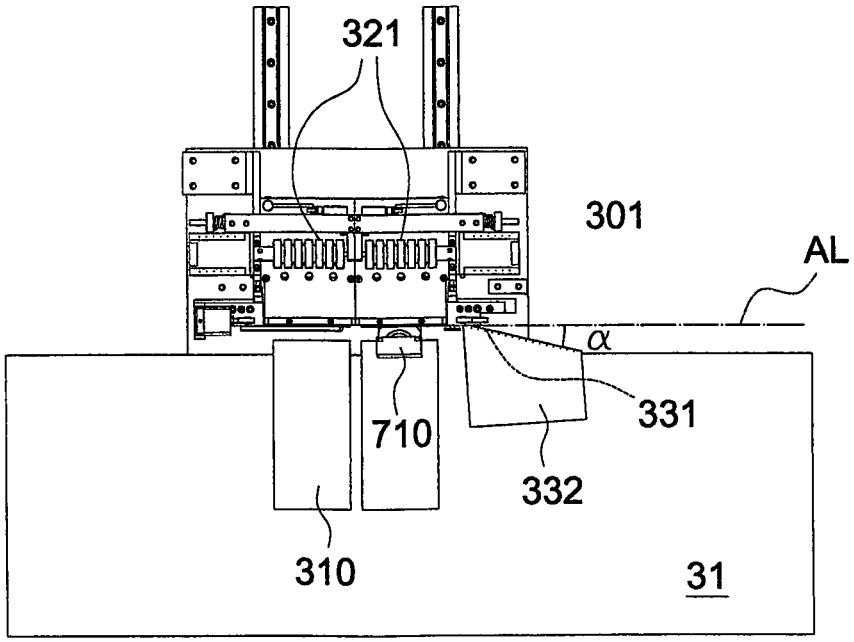
FIG. 22 is a top view of the labeler in FIG. 21.

Labeler 350 is arranged in front of the side welding units 71, 72 in the advancement direction X of the fabrics 31, 41 and along the side edge of the fabrics 31, 41, as shown in FIGS. 21 and 22.

Labeler 350 is provided with means adapted to supply a label 310; Said means comprise at least one bobbin 321 of labels, preferably a photocell for controlling the length of the label, and scissors 323 adapted to cut label 310 to the desired length.

The labeler comprises a welding unit 710 which provides to weld label 310 cut by scissors 323 onto the edge of the fabrics 31, 41 before the side welding of the fabrics 31, 41 and before the cutting of the remaining part of label 310 with the remaining parts of the fabrics 31, 41. Label 310 is welded onto the fabrics 31, 41 by the welding unit 710 so that a part of label 310 protrudes with respect to the side profile of the fabrics 31, 41.

Labeler 350 comprises means 301 adapted to fold label 310, once welded, in the U-shape over the fabrics 31, 41 so as to leave a small part 311 below fabric 41 and adjacent thereto and the most part 312 over fabric 31 and adjacent thereto, as better shown in FIG. 23; the means 301 fold label 310 into a U over a side edge of what will become pillow 10.

Figure 23:
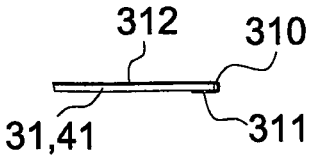
FIG. 23 shows the label folded over the fabrics.
Figure 24:
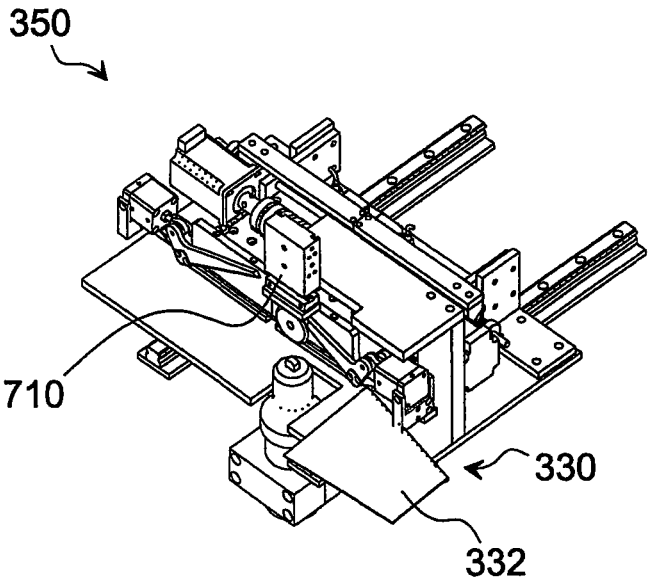
FIGS. 24 and 25 show a detailed view of the part of the labeler intended to fold the label in the U-shape over the fabrics.
Figure 25:
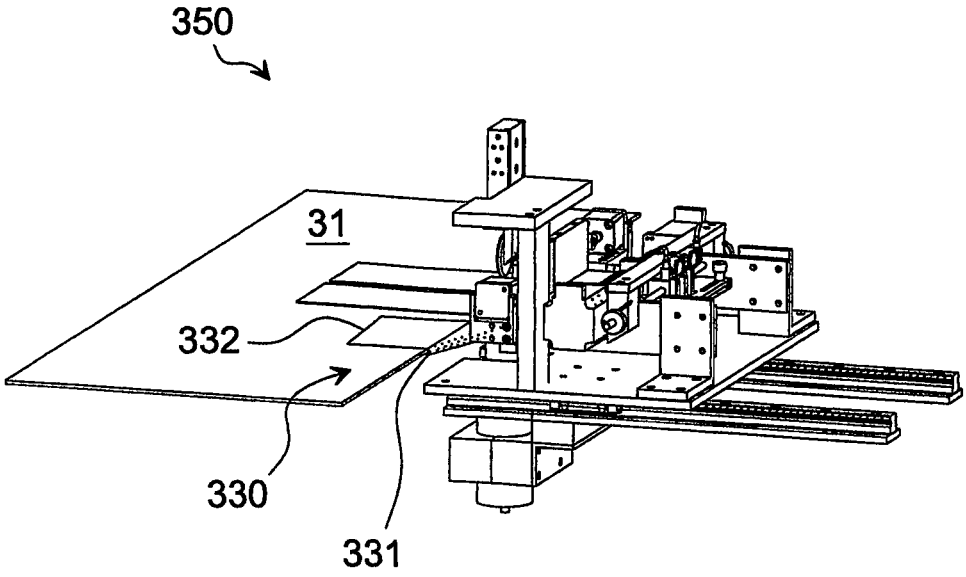
Figure 26:
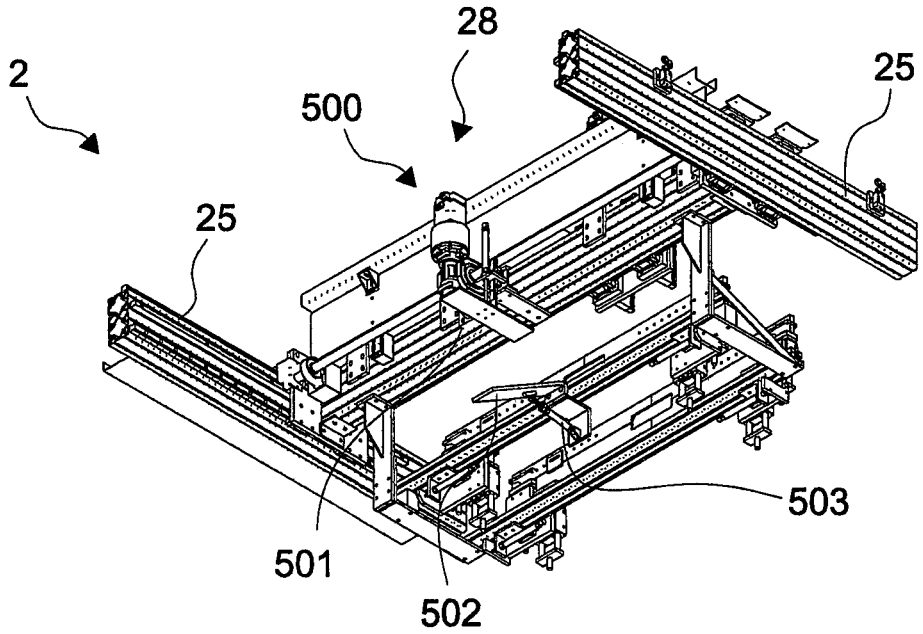
FIG. 26 is a perspective view of a distribution unit of material inside the pillowcase which belongs to the apparatus in FIG. 1.
Figure 27:
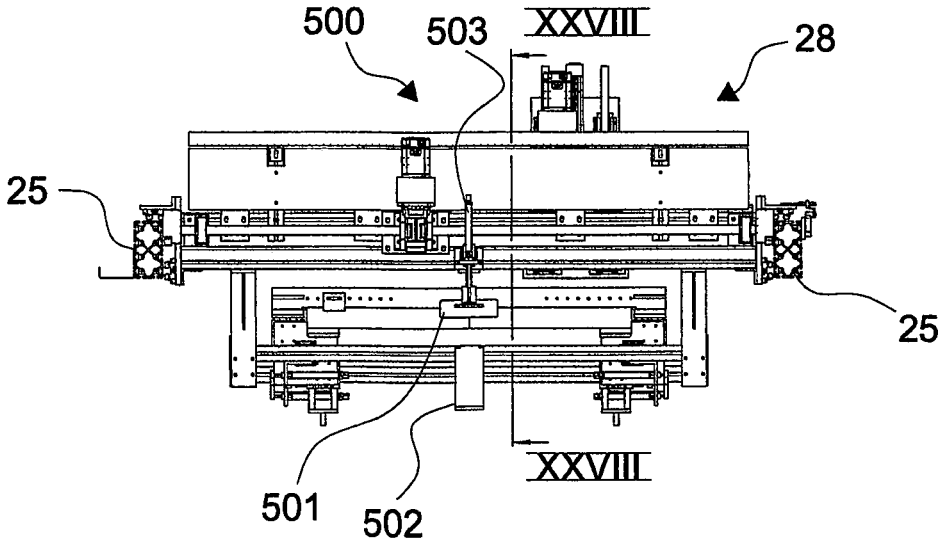
FIG. 27 is a rear view of a part of the apparatus in FIG. 1 where the material distribution unit of FIG. 26 is shown.
Figure 28:
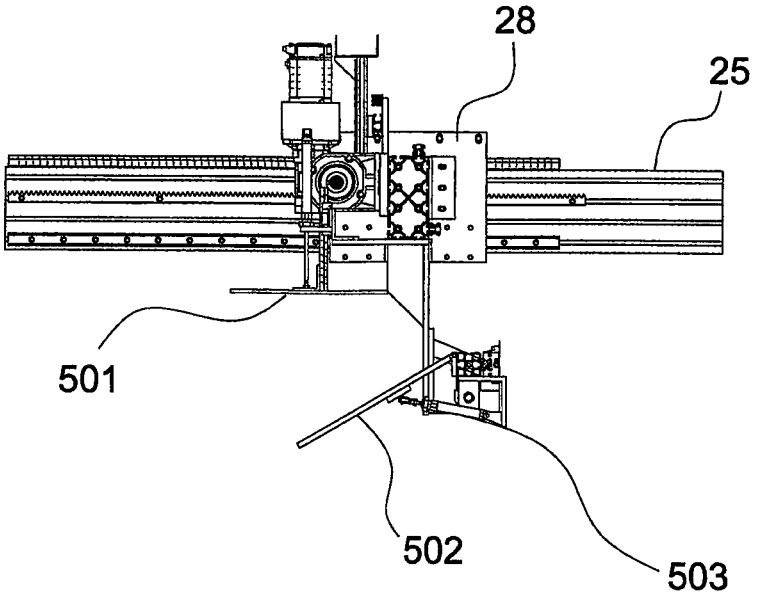
FIG. 28 is a cross-sectional view of the material distribution unit of FIG. 27 according to line XXVIII-XXVIII.
Figure 29:
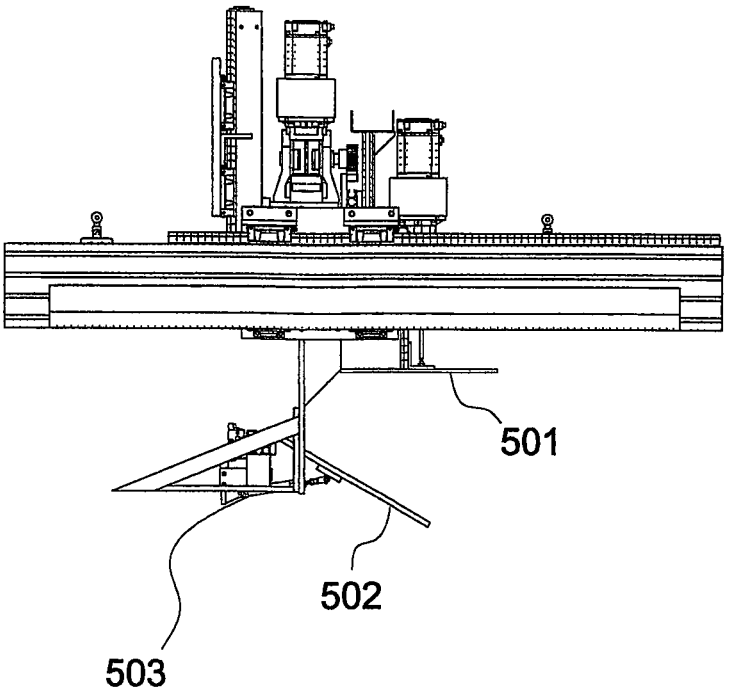
FIG. 29 is a side view of the material distribution unit of FIG. 27.

As shown in FIGS. 21 to 23, label 310 is folded over and arranged on the fabrics 31, 41 in the shape of a U; the means 301 preferably consists of a U-shaped sheet 330 preferably arranged so as to form a given angle α with respect to a longitudinal axis AL. Sheet 330 comprises a smaller lower part 331 and a larger upper part 332, as shown in FIGS. 22, 24, and 25. Sheet 330 is shaped so as to receive label 10 welded on fabrics 31, 41 and folds the label over the fabrics 31, 41 in the shape of a U, as shown in FIG. 23.

Label 10 is therefore welded twice onto the fabrics 31, 41, once by the welding unit 710 to fix it laterally to the fabrics 31, 41 not yet welded and cut, and then by one of the side welding units 71, 72 to fix it on the cover of pillow 10. The first welding of label 310 on the fabrics 31, 41 is removed with the side cutting of the fabrics 31, 41 after the welding thereof.

The control device 300 is adapted to control labeler 350 by synchronizing it with the track units 180 to ensure only one label 310 is arranged on a single pillow 10.

Machine 1, fan 14, device 17, the side welding units 71, 72, press 20, the units 51, the transverse welding unit and the track units 180 are controlled by the control device 300.

At the beginning of the working step of the apparatus according to the invention, the operator inserts the two bobbins of fabric 31, 41 into the related bobbin holder supports provided with bearings to facilitate the rotation thereof, and provided with a brake to keep the material tensioned during the processing step.

Then, the operator starts the feeding cycle in which he/she manually unrolls the fabric bobbins, causes the fabric 31 to pass over the rollers 5 and 6 so that fabric 41 is below fabric 31 in a mirror-like manner in the frame supporting the side welding units 71, 72. Moreover, the operator positions the two side welding units 71, 72 in the correct position, manually moves the fabrics close to the track units 180, starts the rotation of the track units 180 so that the material forming the fabrics 31, 41 is automatically inserted inside between the subunits 181, 182 of each track unit 180 and remains blocked.

Then, the operator enables labeler 350 and the side welding units 71, 72, causes the fabrics 31, 41 to advance and brings the selvedges formed in the specific selvedge removal units 51. After the selvedges are perfectly fed and the material is properly inserted in the tracks, the operator enables press 20 to close the clamps 22, 23 onto the fabrics 31, 41 and the transverse welding in the passage from position A, FIG. 10A, to position B, FIG. 10B.

Press 20 passes from position A, FIG. 10A, to position B, FIG. 10B, with the clamps 22, 23 closed and the side welding units 71, 72 weld the side edges of the pillow with the ultrasound devices and cut the parts of remaining fabric or selvedges with the rollers 75; the clamps 22, 23 of press 20 open in position B, FIG. 10B, immediately after the transverse welding and cutting.

The track units 180 drag the fabrics 31, 41 up to the desired length L of pillowcase 10.

In the movement of press 20 from position B, FIG. 10B, to position A, FIG. 10A, fan 14 blows over the new formed pillowcase to raise it and ensures it is inside the clamps 22, 23 of press 20.

The clamps 22, 23 of press 20 close in position A to allow the filling of the manufactured pillowcase, and the apparatus is ready for the automatic working cycle.

Preferably, the automatic working cycle of the apparatus for manufacturing pillows according to the invention is managed by the control device 300 (shown indicatively in FIG. 1), for example of the PLC type on which all the parameters allowing the pillow to be manufactured may be entered.

The automatic working cycle comprises the following steps.

In the first step, the fiber contained in the container 11 of machine 1 is weighed by means of scale 12 and is transported by means of belt 13 to the fan device 14.

In the initial position of the automatic working cycle, machine 2 has the fabrics 31, 41 advanced up to reaching the desired length of pillow 10, the initial transverse welding of previously manufactured pillow 10, with the side ultrasound units 71, 72 which have already welded the side edges of the fabrics 31, 41 to make a tubular envelope with the fabrics 31 and 41 and with the label already welded to a side edge of the fabrics 31, 41, the rollers 75 which have already cut the excess side parts of the fabrics 31, 41 or selvedges 32, 42 and the units 51 which have already transported the selvedges to a zone external to the working area of the apparatus. The pillowcase 10 is thereby formed.

The clamps 22, 23 of press 20 are closed in position A, FIG. 10A, and device 17 causes the filling pipe 15 to advance so that end 16 is inside space 21.

At this point, fan 14 is controlled so as to blow the quantity of weighed fiber into the previously manufactured pillowcase 10 to fill pillowcase 10.

Figure 14:
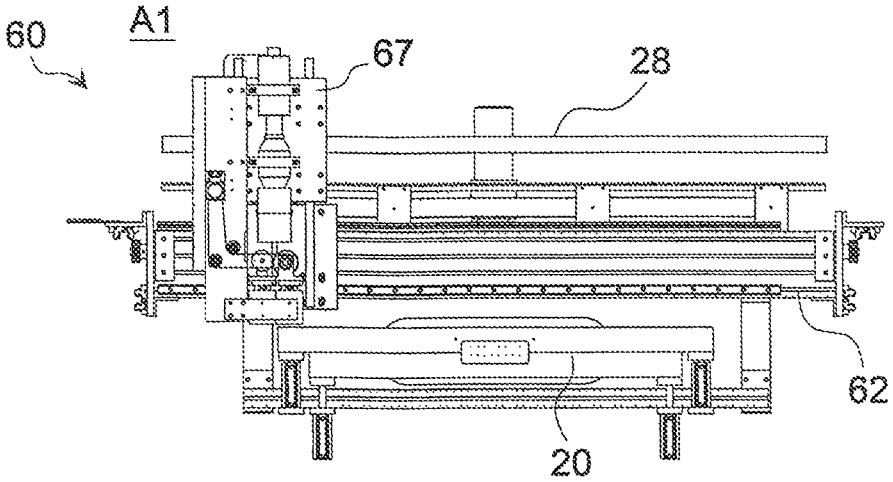
FIGS. 14, 15, and 16 diagrammatically show the various rest steps (FIG. 14) and working steps (FIGS. 15 and 16) of the transverse welding and cutting unit.
Figure 15:
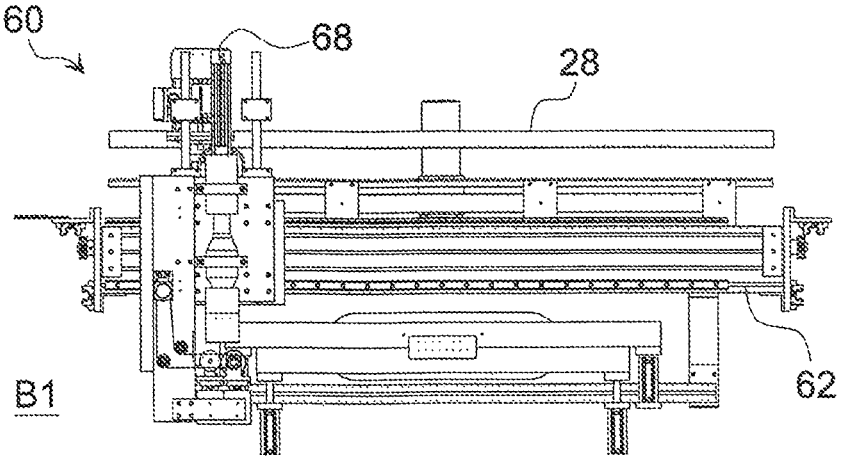
Figure 16:
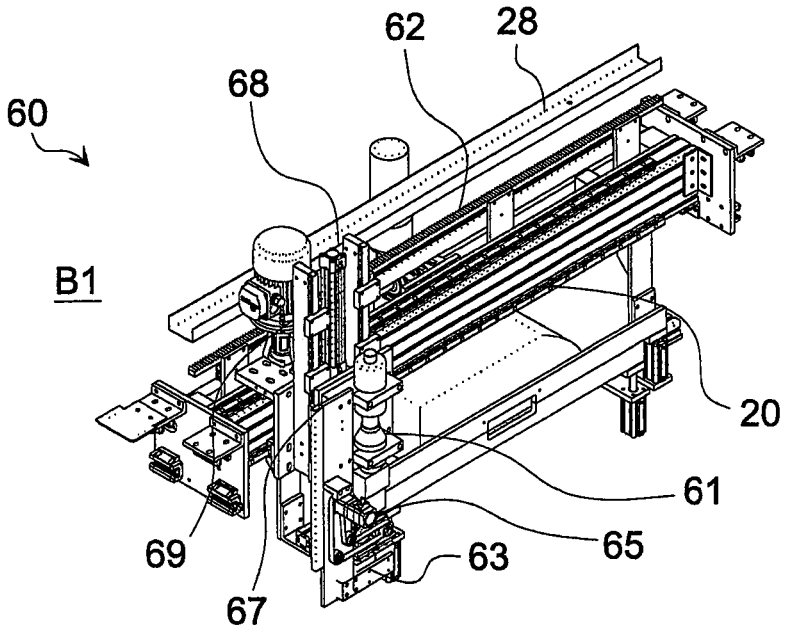
Figure 17:
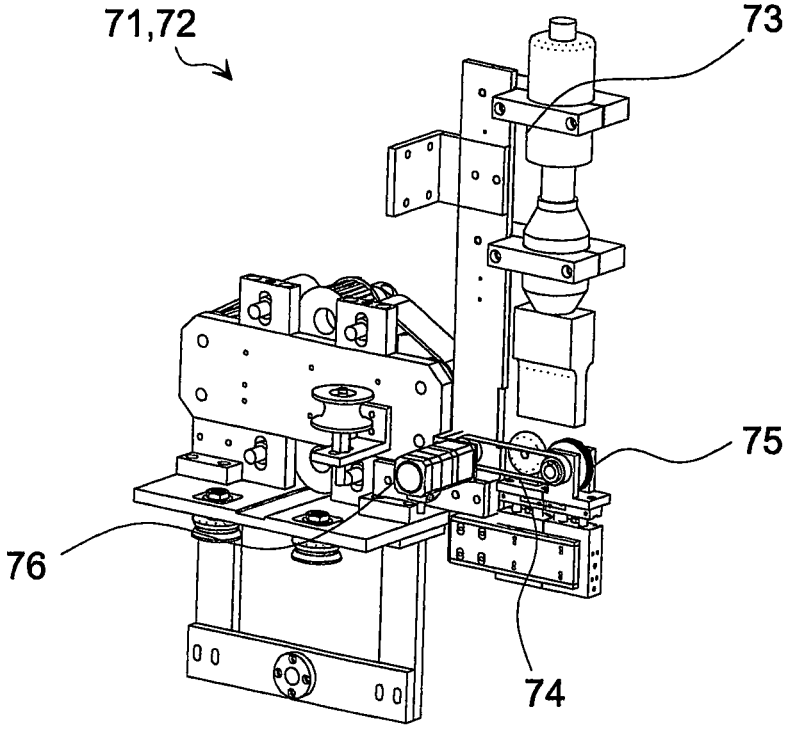
FIG. 17 diagrammatically shows a side welding and cutting unit.
Figure 18:
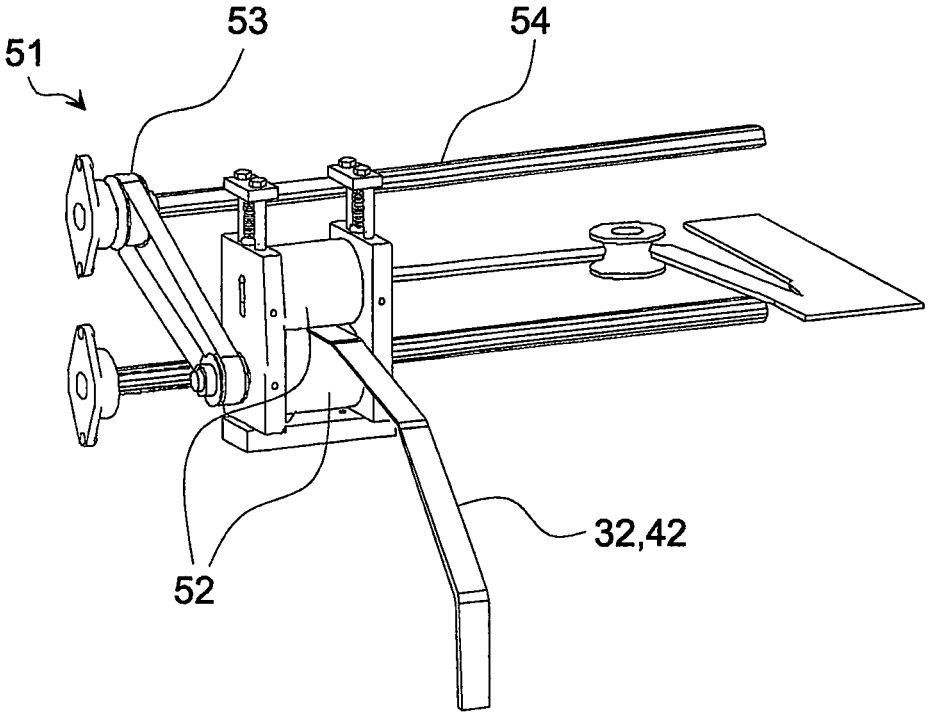
FIG. 18 diagrammatically shows a unit for removing the selvedges of the pillow.

Once the filling step is complete, fan 14 is turned off, device 17 returns end 16 of the telescopic pipe 15 outside pillow 10, press 20 is moved along the advancement direction of the fabrics 31, 41 towards position B, FIG. 10B, and simultaneously the transverse welding unit 60 allows the descent of saddle 67 from the rest position A1, FIG. 14, to the working position B1, FIGS. 15 and 16, and the translation thereof transverse to the advancement direction of the fabrics 31, 41 along guide 62 so that the ultrasound device 61, with roller 63, weld the final part of filled pillow 10 and the initial part of the successive pillow and roller 65 separates the filled pillow 10 from the initial part of the successive pillow.

Once the welding and transverse cutting steps are complete in position B1, FIGS. 15 and 16, saddle 67 returns to the rest position A1, FIG. 14, and the finished pillow falls into a specific unloading slide (not shown in the drawings) while the apparatus is immediately ready to make the successive pillow because during the transverse cutting step, the track units 180 drag the fabrics 31, 41 to already form the cover for the successive pillow with the desired length L while the movable press 20 translates to allow the execution of the transverse cut.

Indeed, the side welding units 71, 72 weld the side edges of the new pillow and cut the remaining parts of fabric; the clamps 22, 23 of press 20 open in position B, FIG. 10B, immediately after the transverse welding and cutting.

In the movement of press 20 from position B, FIG. 10B, to position A, FIG. 10A, fan 14 blows over the new formed pillowcase 10 to raise it and ensure it is inside the clamps 22, 23 of press 20.

The clamps 22, 23 of press 20 close again in position A, FIG. 10A, to allow the filling of the manufactured pillowcase. Thereby, other movement means of the fabrics are not required since the movement means of press 20 also move the fabrics 31, 41.

The automatic cycle is repeated until the set number of pieces to be manufactured is reached.

Preferably the machine 2 comprises also a unit 500 for distributing the material, preferably the fiber, deriving from the machine 1 inside the pillowcase, as shown in FIGS. 26-29. Said unit 500 finds after the press 20 in the advancement direction X of the fabrics 31, 41 and the fiber distribution unit is carried by the frame 28 of press 20 and therefore is also movable in the advancement direction of the fabrics 31, 41 between the two directions A and B, like press 20.

The unit 500 comprises a upper plate 501 and a lower plate 502 which are moved by respective pneumatic cylinders 503 controlled by the control device 300. The plates 501, 502 serve to press the central part of the pillow 10 during the insertion of the fiber inside the pillow 10 to allow the distribution of the fiber in the peripheral parts of the pillow. The initial or rest position of the plate 501 is an horizontal position while the initial or rest position of the plate 502 is a position inclined downwards with respect to the horizontal position of the plate 501.

At the starting of the filling step of the pillowcase (position A, FIG. 10A, of the frame 28), the upper plate 501 is lowered by the respective pneumatic cylinder 503 on the central and upper part of the pillowcase and is kept in said position for the entire filling step of the pillowcase.

The lower plate 502, during the filling step of the pillowcase, always at the position A, FIG. 10A, of the frame 28, is continuously raised towards the lower and central part of the pillowcase, so as to be placed at the horizontal position and at mirror position compared to the plate 501, and lowered towards its rest position by means of the respective pneumatic cylinder 503. In this way both the plates 501, 502 press the pillowcase on its central part only for some time periods of the filling step of the pillowcase and allow the distribution of the fiber inside the pillowcase.

After the end of the filling step of the pillowcase, the pneumatic cylinders 503 are controlled by the control device 300 to carry the plates 501, 502 at initial position thereof.

The invention claimed is:

1. Apparatus for manufacturing pillows, comprising:

at least one first bobbin of a first fabric and a second bobbin of a second fabric, means configured to place the first fabric on the second fabric along their advancement path, means configured to drag the first and the second fabrics, a pair of side welding devices configured to weld the side edges of the first and the second fabrics by forming a tubular envelope by means of the first and the second fabrics, a transverse welding device configured to weld the first and the second fabrics of the tubular envelope transversally to the advancement direction of the fabrics for forming the pillowcase, a press for pressing transversally to the advancement direction of the fabrics the first fabric onto the second fabric when the length of the pillow reaches the desired length, means adapted to insert material inside the pillowcase, means for cutting the fabric already welded by the transverse welding device to separate the pillow that has been manufactured from the initial part of the successive pillow.

2. The apparatus according to claim 1, wherein the press comprises two clamps configured to define in closed position an open space adapted to assure the insert of the material inside the pillowcase.

3. The apparatus according to claim 1, further comprising a movement means of said press along the advancement path of the fabrics.

4. The apparatus according to claim 3, wherein said press movement means are configured to move said press from a first position to a second position, where the press is at a longer distance from the first bobbin and from the second bobbin in position B than in position A.

5. The apparatus according to claim 4, wherein the press is maintained in closed position during the movement from said first position to said second position.

6. The apparatus according to claim 4, wherein said transverse welding device is coupled with a frame of said press and is configured to weld the first and the second fabrics transversally to the advancement direction of the fabrics during the movement of the press from said first position to said second position.

7. The apparatus according to claim 6, wherein said cutting means are coupled with the frame of said press and are configured to cut the fabrics welded by the transverse welding device during the movement of the press from said first position to said second position.

8. The apparatus-according to claim 7, wherein said transverse welding device and said cutting means of the fabrics welded by the transverse welding device are carried by a saddle which is vertically movable on the frame of the press from a rest position to a working position, a saddle in said working position being movable transversally to the advancement direction of the fabrics for the welding and cutting operations.

9. The apparatus according to claim 1, wherein side welding devices are movable transversally to the advancement direction of the fabrics for determining the desired pillow width.

10. The apparatus according to claim 1, further comprising a pair of side cutting devices associated to said couple of side welding devices and configured to cut the remaining side parts of the first and second fabrics.

11. The apparatus according to claim 10, further comprising a pair of devices configured to collect the remaining side parts of the first and second fabrics and to carry the remaining side parts into a zone external to a working area of the apparatus.

12. The apparatus according to claim 1, wherein said means adapted to insert material inside the pillowcase comprise a fan, a telescopic pipe and a device configured to insert inside the pillowcase or extract from the pillowcase the end part of the telescopic pipe, said fan being adapted to blow and to channel inside said telescopic pipe the material for filling the pillow.

13. The apparatus according to claim 12, further comprising a means configured to weigh the material quantity to insert inside the pillow and means adapted to carry the weighed material quantity to said fan.

14. The apparatus according to claim 1, wherein said side welding devices and said transverse welding device comprise ultrasound devices.

15. The apparatus according to claim 1, wherein said means configured to drag the first and the second fabrics are placed after said side welding devices along the advancement direction of the first and second fabrics, said dragging means being configured to determine the length of the pillowcase.

16. The apparatus according to claim 1, further comprising a labeler placed before the side welding devices along the advancement direction of the first and second fabrics, said labeler comprising means adapted to provide a label, means configured to weld the label on the side edges of the first and second fabrics and means configured to fold the label in a U shape on the fabrics so that the greater part of the label is placed adjacent to the first fabric.

17. The apparatus according to claim 1, further comprising a distribution means configured to distributing material inside the pillowcase, said distribution means comprising an upper plate and a lower plate arranged so that the pillowcase is placed between them, and movement means configured to move both the plates toward the central part of the pillowcase to allow the distribution of the material inside the pillowcase, said movement means being configured to move both the plates away from the pillowcase once the pillow is filled.

18. The apparatus according to claim 17, wherein said movement means are configured to lower the upper plate onto the upper and central part of the pillowcase and to keep it in this position for the entire duration of the filling operation of the pillowcase, said movement means being configured to continuously move toward the lower and central part of the pillowcase and away from the pillowcase lower plate for the entire duration of the filling operation of the pillowcase.

* * * * *